United States Patent [19]

Matthews

[11] Patent Number: 4,457,029

[45] Date of Patent: Jul. 3, 1984

[54] TOILET SEAT STRUCTURE

[76] Inventor: Herbert Matthews, 33 N. Evergreen Dr., Selden, N.Y. 11784

[21] Appl. No.: 263,402

[22] Filed: May 14, 1981

[51] Int. Cl.[3] ..... A47K 13/00

[52] U.S. Cl. ..... 4/237

[58] Field of Search ..... 4/234, 235, 237, 239, 4/242

[56] References Cited

U.S. PATENT DOCUMENTS

| | | | |
|---|---|---|---|
| 1,163,149 | 12/1915 | Hooper | 4/237 |
| 2,099,118 | 11/1937 | Kennedy | 4/237 X |
| 2,858,549 | 11/1958 | Carson | 4/242 |
| 3,786,522 | 1/1974 | Kira et al. | 4/237 |
| 4,175,294 | 11/1979 | Boyd | 4/237 |
| 4,244,063 | 1/1981 | Bayard | 4/237 |

FOREIGN PATENT DOCUMENTS

| | | | |
|---|---|---|---|
| 972607 | 2/1951 | France | 4/237 |
| 1267918 | 7/1961 | France | 4/237 |

*Primary Examiner*—Charles E. Phillips

*Attorney, Agent, or Firm*—Kevin Redmond

[57] ABSTRACT

An annular toilet seat having a top surface that includes a raised forward segment and a raised rear segment in which the rear segment is raised to a higher level than the forward segment. Inclined segments referred to as intermediate segments bridge the forward and rear segments. A heart shaped contour line indicating the edge of the highest level points extends through the central region of the forward and rear segments and along the central opening in the intermediate segments. The raised rear segment provides comfort and aids in elimination.

3 Claims, 5 Drawing Figures

TOILET SEAT STRUCTURE

BACKGROUND

1. Field

This invention relates to toilet seats and, more particularly, to the contours of the upper surface of the toilet seat.

2. Prior Art

It is known in the prior art that a number of toilet seats with varying surface configuration are available, as for example, U.S. Pat. Nos. 3,520,005, 3,349,546, 1,163,149 and U.S. Pat. No. Des. 222,965. However, none of these patents show a raised rear section designed to place the body at a specific angle, nor bilevel contours in the front and rear segments to permit varied positions to enhance comfort. U.S. Pat. No. 1,163,149, which contains a rear stop, is designed to prevent the body from moving rearward on the seat, rather than to raise the position of the body.

FIG. 1 illustrates a prior art toilet and toilet seat structure, comprising a toilet 102 mounted on a floor 101 and supporting a water closet 103, seat 105 and seat cover 104. The upper surface of the seat 105 essentially lies in the horizontal plane, as indicated by the right angle designated by drawing numeral 106 which it makes with the vertical. Although not illustrated, it is apparent that suitable flow-control devices are associated with the water closet 103, and the bowl 107 to control water flow in a suitable manner.

SUMMARY

It is an object of the present invention to provide a toilet seat having a rear segment elevated above a forward segment and incline intermediate segments bridging the front and rear segments.

It is an object of the present invention to provide a generally annular one piece toilet seat of the configuration described which may be made of a suitable solid material such as wood, plastic, aluminum or porous resilient materials, such as rubber or plastic, to increase ventilation and enhance comfort.

It is an object of the present invention to provide a toilet seat structure having a one piece generally annular seat with a rear segment elevated above the forward segment and a cover complementarily configured to abut the varied contours of the upper surface of the seat.

Other objects, advantages and important features of the invention will be apparent from a study of the specifications following, taken with the drawing, which together describe, disclose, illustrate and show a preferred embodiment of the invention and what is now considered and believed to be the best mode of practice of principles thereof. Still other embodiments, modifications, procedures or equivalents may appear to those having the benefit of the teachings herein and such other embodiments, modifications, procedures or equivalents are intended to be reserved, especially as they fall within the scope and breadth of the subjoint claims.

In its most rudimentary form, the present invention comprises an annular seat having an opening thereto and a bottom surface for support by the toilet bowl. The seat contains a top surface with a forward segment having a generally horizontal portion and a rear segment having a generally horizontal portion which is elevated above the forward segment. Inclined segments referred to as intermediate segments bridge the forward and rear segments. A heart shaped contour line indicating the edge of the higher level points extends through the central regions of the forward and rear segments and along the opening in the intermediate segments. The upper surface of the seat tapers downward from the contour line towards the opening producing a seat which provides for varied positions which enhance comfort and elimination. A preferred embodiment of the invention is fabricated from resilient material such as rubber or plastic and contains pores to provide cushioning and ventilation.

BRIEF DESCRIPTION OF THE DRAWINGS

FIG. 2 illustrates the present invention comprising a seat 202, a rear segment of the seat 204 elevated above the forward segment 203, an intermediate segment 206 joining the forward and rear segments, and a seat cover 201 having a lower surface 205 contoured to conform to the upper surface of the seat 202 by means of a first concave segment 210, a convex segment 211, and a second concave section 212 which coincides with the forward, intermediate and rear segments of the seat 202 when the seat cover is in the closed position.

FIG. 3 is a front view of the seat 202 showing the elevated rear section 204 formed of two flattened peaks 305A and 305B separated by valley 307 with outer rear peak sides 303 and 304 tapering towards the outer perimeter 306 and away from the flattened peaks 305A and 305B whose upper surfaces are essentially horizontal. The forward segment 203 is also formed of two flattened peaks 302A and 302B separated by valley 310 with outer forward peak sides 307 and 308 tapering towards the outer periphery 306 and away from the flattened peaks 302A and 302B, whose upper surfaces are also essentially horizontal. Areas 305A and 305B on the rear of the seat represent the surface of two other peaks which are somewhat flattened. Although the flattening is not as pronounced as with areas 302A and 302B, the uppermost areas may be considered as approximating a horizontal line in the sense that a tangent may be used to approximate a small segment of a curved line. The seat may be made of a variety of materials including rubber or plastic to provide cushioning and such material may contain pores such as pore 309 to provide ventilation. The pores pass completely through the seat and where the seat is raised above the bowl by such means as small support legs 301A and 301B ventilation and comfort are enhanced. It should be noted that the use of pores for ventilation is not restricted to seats fabricated from resilient material, but can be used with such materials as wood and aluminum; however, to facilitate cleaning, the pores in such materials are made relatively large and are plastic lined. In an alternate embodiment, the pores are contained in a cover made of flexible material such as preformed plastic sheet designed to fit over the outer surface of the seat and which can be easily removed for cleaning.

FIG. 4 is a side elevation view of the invention showing the forward portion 203, the essentially horizontal portion of the flattened forward peak 302B, the elevated rear peak 305B. The generally elevated rear segment 204 and the transition section 206 which comprises a concave portion 402, an inclined portion 403 to the forward peak 302B and an inclined portion 401 to the rear peak 305B.

FIG. 5 is a plan view of the seat clearly showing the generally annular inner and outer peripheries 501 and 306 respectively. Most important in this view, however, is the heart shaped contour line 505. The peaks of the heart 502 lie on the upper rear surface of the seat and are separated by a valley 503, while the tip of the heart 504 lies centered in the forward segment on the seat. The contour line 505, generally bisects the upper surface of the forward and rear segments, but is tangent to the inner periphery in the area of the intermediate segments. This contour line generally represents the locus of high elevation points on the seats upper surface and defines the edge where the seat slopes downward towards the inner periphery. As this contour line is traced from either the forward or rear segments towards the intermediate segments, the distance between the contour line and the inner periphery becomes less, resulting in an increasing slope which becomes vertical along the intermediate segments. The rear inner slopes 506A and 506B between the contour line 505 and the inner periphery as well as the forward inner slopes 507A and 507B are far more gradual than the vertical slope along the intermediate segments and are intended for use in supporting the body in varied positions.

Figure 1:
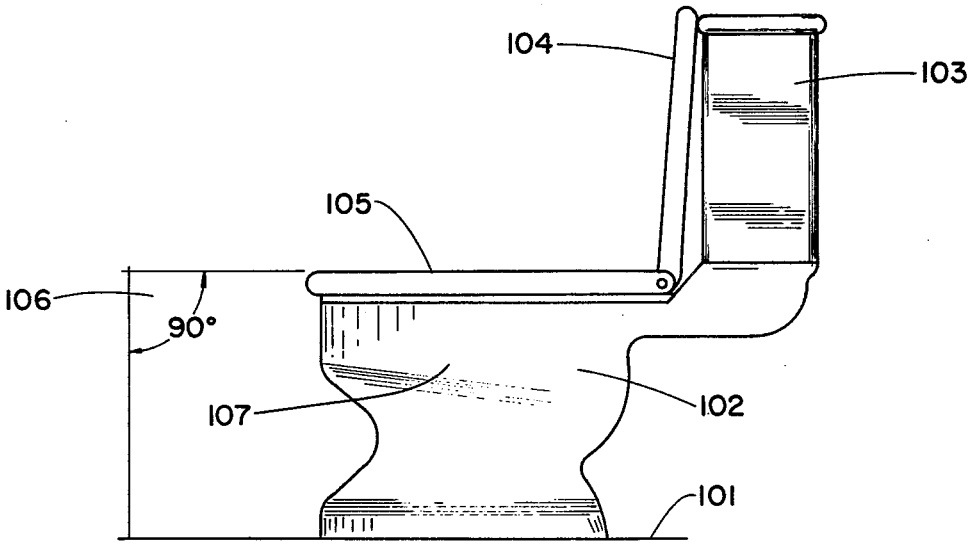
Fig. 1 PRIOR ART
FIG. 1 is a side elevation view of a prior art toilet and toilet seat structure.
Figure 2:
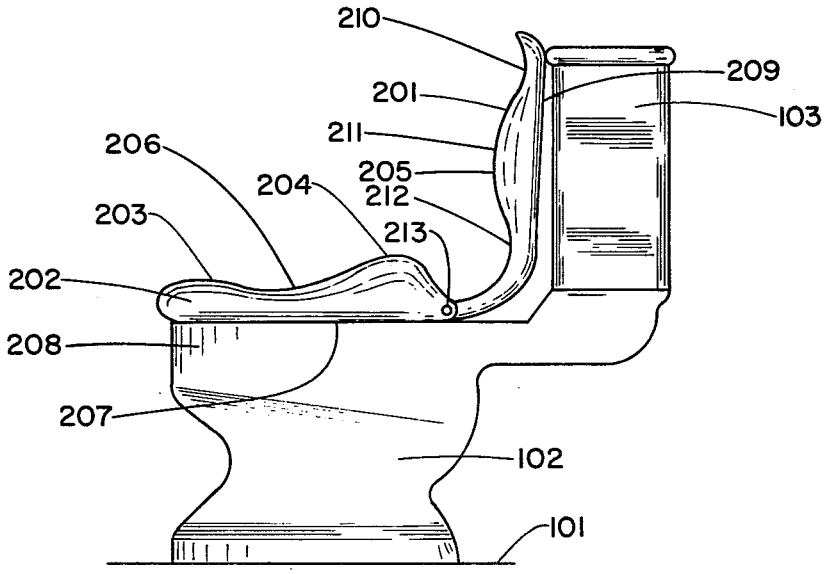
FIG. 2 is a side elevation of the present invention showing its position on a conventional toilet.
Figure 4:
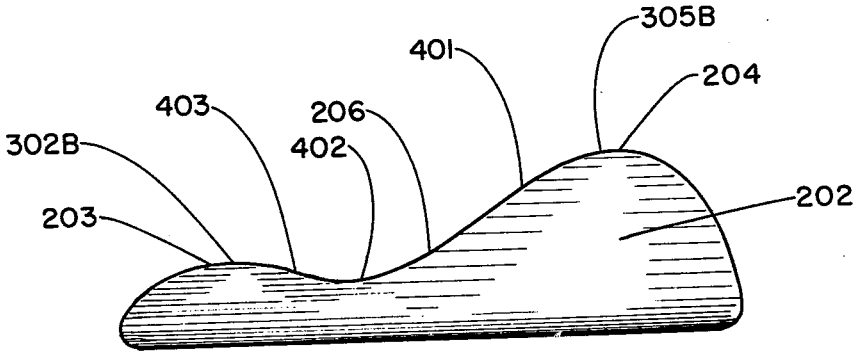
FIG. 4 is a side elevation view of the present invention.
Figure 5:
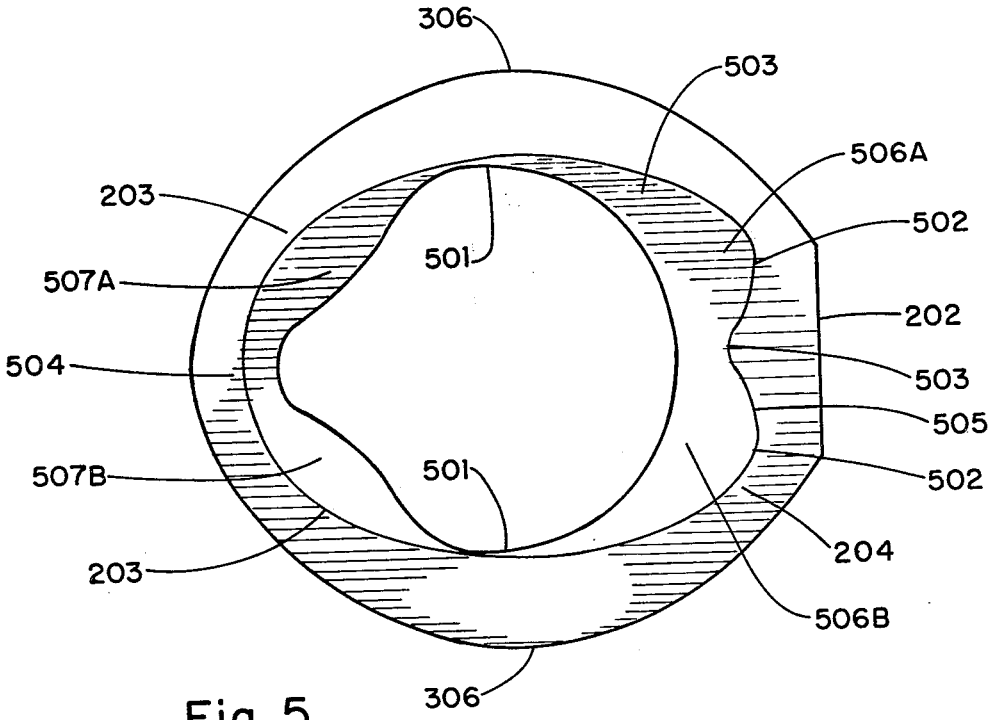
FIG. 5 is a plan view of the present invention.
Figure 3:
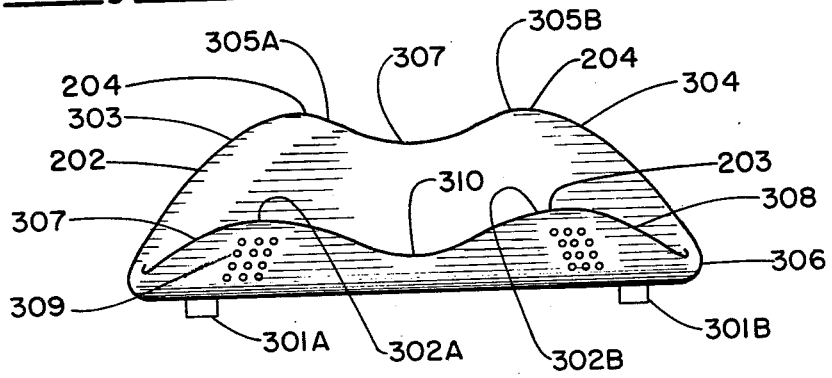
FIG. 3 is a front elevation view of the present invention.

At no point does the contour line 501 touch the outer periphery 306 and accordingly the outer slopes between the contour line 505 and the outer periphery are gradual and are also intended for use in supporting the body.

The primary purpose of the elevated rear segment 204 of the seat 202 is to induce the user to assume an open position which has been found by test to encourage peristalsis and elimination. This is in contrast to prior art designs which assumed that the squatting position assists in this process. The squatting position has actually been found in some cases to inhibit peristalsis and elimination. Additional pressure added during these processes due to cramping may lead to hemorrhoids. Either the open position or the ability to move from one position to another is far more important than a fixed, cramped or squatting position induced in prior art devices by a raised forward portion of the seat. Such prior art devices elevated the forward segment of the seat, making it difficult to change position, and thereby hampered the process for some individuals as well as made the seat uncomfortable, especially if the fixed position had to be endured for any prolonged period.

In the present invention, the forward segment 203 is slightly elevated with respect to a concave portion of the intermediate segments 402, providing more conforming seat and also allowing the squatting position to be assumed if desired by merely using the raised forward position in conjunction with the rear slopes 506A and 506B. The present invention is contoured to primarily induce the open position, but by a slight adjustment of body position, the open, erect or squatting position may be assumed as desired.

The cover 201 is designed to mate with the seat to provide a neatly finished appearance when closed. The cover may also be fabricated from suitable material, such as wood, plastic, aluminum or the like. The cover comprises an upper surface 209, which is essentially planar, and a lower surface having forward, intermediate and rear segments 210, 211 and 212, respectively which are complementarily configured with respect to the upper surface of the seat to abut the forward, rear and intermediate segment of the seat 203, 204 and 206 respectively. The mounting mechanism, may be of any suitable type, but is typically a hinge, such as hinge 213 secured to the toilet 102, designed to permit raising and lowering the cover and seat.

While the invention has been described and disclosed in terms of an embodiment which it has assumed in practice, the scope of the invention should not be deemed to be limited by the precise embodiment herein shown, illustrated, described and disclosed and it is to be understood that such other embodiments are intended to be reserved especially as they fall within the scope of the subjoined claims.

What I claim is:

1. A toilet seat structure being oriented in the horizontal plane for reference purposes and comprising a one piece generally annular seat with an opening there through, the seat having:

(a) a bottom surface designed to rest on the toilet bowl for support, (b) a top surface to support the body having:

(i) a forward segment containing a first raised area, the area of highest elevation within said first raised area being located generally centrally between the inner and outer periphery of the seat, (ii) a rear segment containing a second raised area, the area of highest elevation with said second raised area being elevated substantially above said first raised area of the forward segment and located generally centrally between the inner and outer periphery of the seat, (iii) an intermediate segment bridging the forward and rear segments, the central portion of the intermediate segment between the forward and rear segment being generally horizontal and the edge of the intermediate segment in its central portion adjacent the opening forming a generally vertical wall joining the upper and lower surface of the seat, wherein the intermediate segment extends downward in its central portion to a generally horizontal area which is at an elevation below that of the forward horizontal segment and further comprises a first inclined portion which connects the forward segment to the intermediate segment and a second inclined portion which connects the rear segment to the intermediate segment, said seat structure comprising a generally heart shaped contour line on the upper surface of the seat with the peaks of the heart located symmetrically on the rear segment and the point of the heart located centrally on the front segment, the contour line generally bisecting the forward rear segments but touching the inner periphery formed by the opening, the upper surface sloping generally downward from the contour line to the inner periphery, said seat structure further including a first centrally located concave portion on the upper surface on the forward segment and a second centrally located concave portion in the rear segment, the first and second concave portions divide the generally horizontal areas in the forward and rear segments into two sets of flattened peaks for each segment, said seat structure further comprising a lid having:

(a) an upper generally planar surface, (b) a lower surface complementarily configured to the upper surface of the seat to abut the forward, rear and intermediate segments thereof, and (c) means mounting the lid for movement from a position overlying the seat to another position.

2. A toilet seat structure as claimed in claim 1 wherein the seat is made of resilient porous material where the pores extend through the seat to provide ventilation.

3. A toilet seat structure as claimed in claim 1, wherein a conforming porous resilient cover is positioned over the seat to provide ventilation.

* * * * *